US008066443B2

(12) United States Patent
Thiebaut et al.

(10) Patent No.: US 8,066,443 B2
(45) Date of Patent: Nov. 29, 2011

(54) DEVICE FOR PACKAGING AND APPLYING A PRODUCT

(75) Inventors: Laure Thiebaut, Clichy (FR); Philippe Bonneyrat, Herblay (FR)

(73) Assignee: L'Oreal, Paris (FR)

( * ) Notice: Subject to any disclaimer, the term of this patent is extended or adjusted under 35 U.S.C. 154(b) by 469 days.

(21) Appl. No.: 11/874,774

(22) Filed: Oct. 18, 2007

(65) Prior Publication Data

US 2008/0095566 A1 Apr. 24, 2008

Related U.S. Application Data

(60) Provisional application No. 60/854,438, filed on Oct. 26, 2006.

(30) Foreign Application Priority Data

Oct. 18, 2006 (FR) ..... 06 54343

(51) Int. Cl.
*B43K 21/00* (2006.01)

(52) U.S. Cl. ..... 401/82

(58) Field of Classification Search ..... 401/6, 9–11, 401/55, 61, 82, 87, 88, 176, 177, 179, 171, 401/49, 95, 98, 83, 85; 132/317, 318; 222/386, 222/390

See application file for complete search history.

(56) References Cited

U.S. PATENT DOCUMENTS 1,675,365 A 7/1928 McAtree
2,196,127 A * 4/1940 Stogran ..... 401/81
2,477,245 A * 7/1949 Giddings et al. ..... 132/125
2,609,093 A * 9/1952 Lynn ..... 401/82
2,887,117 A * 5/1959 Rosholt ..... 132/107
3,902,814 A * 9/1975 Cardia ..... 401/83
4,815,485 A * 3/1989 Morel ..... 132/318
5,167,462 A * 12/1992 Lucas ..... 401/82
5,800,886 A * 9/1998 Vallauri et al. ..... 428/35.8
5,833,382 A * 11/1998 Jenks et al. ..... 401/82
5,897,263 A * 4/1999 Fattori ..... 401/82
5,984,553 A * 11/1999 Piscopo et al. ..... 401/82
6,022,160 A * 2/2000 Sakurai ..... 401/64
6,315,479 B1 * 11/2001 Sakurai ..... 401/59
6,435,195 B1 * 8/2002 Joulia ..... 132/320

(Continued)

FOREIGN PATENT DOCUMENTS

EP 0 504 050 9/1992

(Continued)

OTHER PUBLICATIONS

U.S. Appl. No. 11/768,044, filed Jun. 25, 2007, Thiebaut.
U.S. Appl. No. 12/180,388, filed Jul. 25, 2008, Bonneyrat.

*Primary Examiner* — David Walczak
*Assistant Examiner* — Jennifer C Chiang
(74) *Attorney, Agent, or Firm* — Oblon, Spivak, McClelland, Maier & Neustadt, L.L.P.

(57) ABSTRACT

A packaging and application device for a cosmetic product. The device may include a platform, a tube forming a housing for the product and a driving mechanism for translational movement of the platform in the tube. The movement of the platform allows dispensing of product via a dispensing opening in the tube. A side wall of the tube includes an inner cross-section having an inwards-concave portion and an inwards-convex portion. The tube is arranged in a base having an outwards-convex outer cross-section.

23 Claims, 5 Drawing Sheets

U.S. PATENT DOCUMENTS

| | | | | |
|---|---|---|---|---|
| 6,543,953 | B1 | 4/2003 | Kim | |
| 7,073,966 | B2 * | 7/2006 | Murakoshi | 401/87 |
| 2004/0213626 | A1 * | 10/2004 | Ramet | 401/176 |
| 2006/0188315 | A1 | 8/2006 | Look et al. | |
| 2006/0198692 | A1 * | 9/2006 | Petit | 401/266 |
| 2007/0025802 | A1 * | 2/2007 | Dieudonat et al. | 401/100 |
| 2007/0081848 | A1 * | 4/2007 | Ramet | 401/11 |
| 2007/0104531 | A1 | 5/2007 | Thiebaut | |

FOREIGN PATENT DOCUMENTS

| | | | |
|---|---|---|---|
| EP | 1 647 200 | A2 | 4/2006 |
| FR | 791 234 | A | 12/1935 |
| FR | 2879084 | A1 * | 6/2006 |
| WO | WO 98/47403 | | 10/1998 |

* cited by examiner

DEVICE FOR PACKAGING AND APPLYING A PRODUCT

CROSS-REFERENCE TO RELATED APPLICATIONS

This document claims priority to French Application Number 06 54343, filed Oct. 18, 2006 and U.S. Provisional Application No. 60/854,438, filed Oct. 26, 2006, the entire contents of which are hereby incorporated by reference.

FIELD OF THE INVENTION

The present invention relates to a device for packaging and applying a product. The device can be particularly advantageous, for example, for a cosmetic make-up and/or care product intended to be applied to keratinous fibers. Keratinous fibers means, for example, fibers such as hair or eyelashes, including artificial hair or false eyelashes. "Cosmetic product" means a product as defined in Council Directive 93/35/EEC of 14 Jun. 1993.

BACKGROUND OF THE INVENTION

Discussion of Background

EP 0504050 describes a device for packaging and applying a solidified product positioned on a plunger inside a tube. The product is dispensed by a translational movement of the plunger, and therefore of the solidified product, in the direction of a dispensing opening in the tube. For dispensing the product, one end of the solidified product intended to be placed in direct contact with the skin surface to be coated is positioned protruding from the dispensing opening.

This translational movement of the plunger is obtained by activation of a slider protruding from the external perimeter of the tube. The slider passes through a slot formed in the tube in order to cooperate with the plunger so that a translational movement of the slider brings about an identical translational movement of the solidified product in the tube. Between two uses, a cap is mounted around the dispensing opening.

In these example embodiments, the tube includes a substantially oval dispensing opening. The solidified product then also has an oval cross-section. These examples are designed particularly for the application of a deodorant under the armpits. These devices are not suited to non-continuous surfaces such as a layer of keratinous fibers. They are, furthermore, bulky, and it is difficult to reliably obtain the mechanisms for guaranteeing sealing for storing the product.

Furthermore, U.S. Pat. No. 2,887,117 describes a hair product applicator that includes spikes at its dispensing aperture. The spikes are configured to allow a massage of the scalp, and furthermore provide a means of attaching a member for closing the dispensing aperture.

SUMMARY OF THE INVENTION

One object of the present invention is therefore to provide a product packaging and application device that makes it possible to overcome at least one of the above-mentioned drawbacks. Another object of the present invention is to provide a packaging device which is compact, and can be manipulated easily with only one hand, leaving the other hand free to, for example, position a mirror opposite the eyes to check the application of the product. Another object of the present invention is to provide a device that includes a dispensing opening with dimensions adapted to the application purpose of the product contained in the device.

An object of the present invention, according to one of its aspects, is a packaging and application device for a cosmetic product. The device can include a platform, a tube forming a housing for the product and a driving mechanism for translational movement of the platform in the tube. The movement of the platform can allow dispensing of product via a dispensing opening in the tube, and the tube can be arranged in a base. According to a preferred example, at least one out of an outer cross-section of the base or an inner cross-section of a side wall of the tube includes an inwards-convex portion, the base and the tube being of non-homothetic cross-section. Thus, the driving mechanism can be contained within the maximum cross-section of the base, for example, and the device is advantageously compact.

For example, the side wall of the tube can include an inner cross-section having an inwards-concave portion and an inwards-convex portion, and the base can include an outwards-convex outer cross-section.

The platform can be in sealed contact with the side wall of the tube, in at least one position of the platform in the tube. For instance, the platform can be in sealed contact with the internal perimeter of the side wall when it is in the low position in the tube and the product does not protrude from the dispensing opening. This provision is advantageous, for example, when packing of the device with product is carried out via the dispensing opening.

According to an example, the device can include a cap configured to cooperate with the base. Thus, between two uses, the product can be protected in the volume delimited by the tube, the platform and the cap. Advantageously, the cap can provide sealed closure of the base, the product, tube and platform being disposed inside this sealed volume.

The driving mechanism can be contained within the maximum cross-section of the base. This provision contributes towards the compactness of the device. Advantageously, in one example, the driving mechanism is disposed between the side wall of the tube and the base, and for example, between the area of the side wall having the inwards-convex portion and the base. The driving mechanism can be slid in a slot in the tube. This slot can advantageously be made through the side wall, in an axial portion of this wall surrounded by the base. Thus the slot can be concealed by the base. Moreover, where the driving mechanism is a pushbutton, for example, the latter can protrude longitudinally from the base. In this example, the driving mechanism includes a longitudinal portion that extends into the base and includes a lug passing through the slot. In this example, the slot can be formed in a longitudinal portion of the tube at a distance from the longitudinal portion in which the platform can be moved. For example, the lug of the driving mechanism can cooperate with a distal end of a rod sticking out from a bottom of the platform, and the rod can extend into the tube in the direction of a bottom of the base.

According to an example, the pushbutton can include a free end disposed substantially at the level of the platform. In this example, the slot can be configured to allow the movement of the platform as far as the level of the opening in the tube. For example, when the platform is in the high position and the platform is situated substantially at the level of the dispensing opening, the free end of the pushbutton is situated substantially at the level of the dispensing opening.

According to an example, the slot can advantageously include two axial limit stops so as to determine the maximum permitted axial travel for the platform. This distance between the two axial limit stops corresponds substantially to the height of product which is for example disposed on the platform. For example, a ratio of the height of product before the first use to the total height of the device can be, for example, between 0.3 and 0.8, and, for example, preferentially between 0.4 and 0.6, for example, advantageously of the order of 0.5.

According to an example, the platform forms a seat for receiving the product which can be in stick form. Stick form means, for example, a product that keeps its predetermined shape in the absence of stress, at ambient temperature and atmospheric pressure. A product packaged in stick form can be self-supporting, preferably for at least 60 seconds. Generally, such sticks can be obtained by hot casting of the product or also by extrusion, for example.

Advantageously, the product stick can be a solid composition, for example, dry-dispersible. Dry-dispersible designates a composition capable, at ambient temperature, of forming an adhesive and encasing deposit on a substrate, for example keratinous fibers, and, for example, eyelashes, when they are respectively placed in direct contact with each other, without requiring prior preparation, and in this example without requiring the composition to be placed in contact with an aqueous phase beforehand. Cake mascaras can be water-dispersible and must first be partially solubilised in order to be applied to the keratinous fibers and form an adhesive and encasing deposit, whereas a dry-dispersible composition according to an example aspect of the invention can be removed, transferred and spread.

For example, the product stick can be a solid composition having a hardness lying between 500 and 18,200 Pa, for example between 900 and 10,000 Pa, and for example between 1,800 and 8,200 Pa. Such a hardness can allow a composition to be obtained that is sufficiently rigid to be in stick form whilst having a fairly "soft" texture in order to allow easy application on the eyelashes, for example deposition of material by placing in direct contact with the eyelashes, without exerting pressure on the eyelash fringe.

A method that can be used to determine the hardness of a cosmetic composition in accordance with one aspect of the invention is the so-called "cheese-wire" method, for example. In the "cheese wire" method, a stick is prepared of the composition whereof the hardness is to be determined. For example, the stick is obtained by casting a composition in an aluminium mould placed for 45 minutes at −28° C., then removed from the mould and packed into a packaging item, for example a pen, and then kept at a temperature of 20° C. for the 24 hours preceding the measurement. A rigid tungsten wire with a diameter of 250 μm, for example, is moved forward relative to the stick at a speed of 100 mm/min, for example, so as to cut the stick transversely with the wire. The measured hardness corresponds to the maximum shearing force exerted by the wire on the stick at 20° C., this force can be measured by means of a DFGS2 dynamometer marketed by the company INDELCO-CHATILLON, for example. The measurement is repeated 6 times. The average of the 6 values read by the dynamometer mentioned above, denoted Y, is given in grams. This average is converted into pascals by the following equation in order to obtain the hardness value of the stick:

$$(Y\times10^{-3}\times9.8)/\text{surface area of the cross-section of the stick (in m}^2)$$

In the case of a cylindrical stick with circular cross-section, the surface area of the cross-section is equal to $\pi\times R^2$, R being the radius of the stick expressed in meters. As an example, hardness of the compositions according to one aspect of the present invention is such that the compositions are self-supporting and furthermore can be easily disintegrated to form a deposit on the surface of the keratinous fibers when they are brought into contact with them. For example, the product stick can have a baton shape, having a longitudinal axis. This stick can include a tubular, for example a cylindrical, portion.

The platform can be permeable to the product, for example when the product disposed on this platform is in stick form, and was deposited there by hot casting, solidification of the stick can take place in situ in the tube. In this example, the tube advantageously includes a second opening, axially opposite the first opening, so as to allow this casting of the product in the housing. The device is then positioned "top down" under product injection means.

The dispensing opening in the tube can be closed off before the first use. This provision can be useful, for example, when the product is cast in its housing from an opening opposite the dispensing opening. In order to close off this dispensing opening, a protective cap is provided, for example. If the protective cap is rigid, it can also allow shaping of a free end of the cast product.

In one example, the tube can widen out in the direction of its dispensing opening. The internal side wall of the tube is thus easier to remove from the mould. In this example, as soon as the platform is moved from its initial position, a space is created between the external perimeter of the platform and the internal perimeter of the side wall. Movement can thus be performed without frictional stresses preventing it.

The dispensing opening in the tube can have a perimeter inner cross-section substantially identical to that of the inner cross-section of the tube. It then has an inwards-concave portion and an inwards-convex portion. Thus the product positioned on the platform is moved through the dispensing opening without being modified by the latter. The dispensed product, if it is in cake form, then also has a concave portion and a convex portion.

This shape of opening for product dispensing is, for example, adapted to come into contact with an eyelash fringe. This is because, as the eyelashes are located at the edge of the eyelid and this eyelid follows the contour of the eyeball, the base of the eyelashes is therefore situated on a curve. With such a shape of opening, it is thus possible to coat a row of eyelashes by coating them with product from substantially the same point relative to their respective base. The make-up can thus be uniform.

In an example, separating/combing elements can be arranged at the periphery of the dispensing opening, these separating/combing elements extending parallel to an axis of translational movement of the platform in the tube. They can be configured so as to engage with the keratinous fibers in order to separate/comb them simultaneously with and/or after application of the product on the fibers by means of the product dispensed at the dispensing opening. The separating/combing elements are advantageously tapered, for example in the form of teeth or hair, in order to allow combing and/or effective separating of keratinous fibers, and, for example, eyelashes.

The inwards-concave portion and the inwards-convex portion can be substantially superposable, and disposed opposite each other so that the dispensing opening forms a curved slit. Such a provision makes it possible, for example, to comply with the layout of an eyelash fringe at the edge of an eyelid.

Another object of the invention is a method of applying a product on the eyelashes using of a device according to the invention. For example, the device is moved along a defined path in the same plane substantially perpendicular to the cornea and parallel to the plane of the nose. This path can be, for example, that of the dispensing aperture which is then brought tangentially to the cornea in contact with the base of a row of eyelashes, the dispensing aperture then being moved along the row of eyelashes in the direction of their respective free end, while constraining the eyelashes against the dispensing opening. The movement of the device can be done in an iterative loop defined in one or more planes substantially perpendicular to the cornea and parallel to the plane of the nose, according to the make-up sought.

As should be apparent, the invention can provide a number of advantageous features and benefits. It is to be understood that, in practicing the invention, an embodiment can be constructed to include one or more features or benefits of embodiments, disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 2:
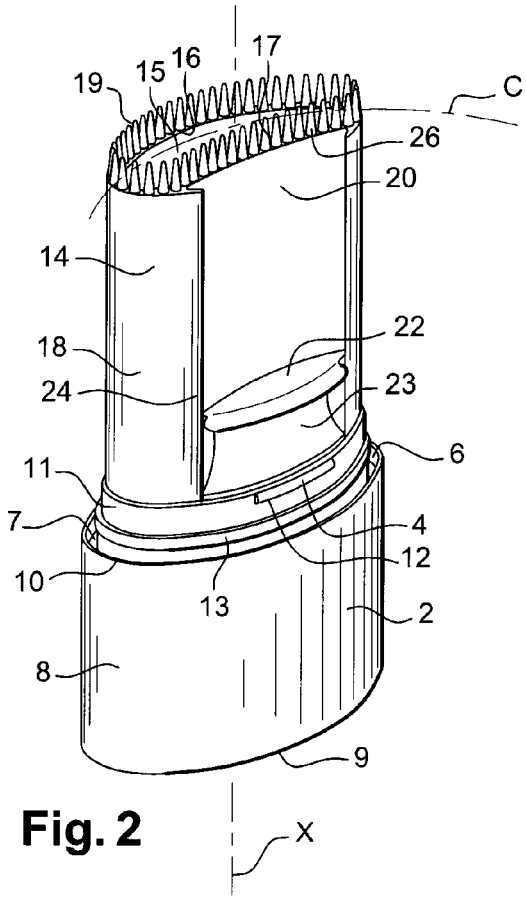
FIG. 2 is an outline perspective view of an example device with a pushbutton in the low position.

Referring now to the drawings, like reference numerals are utilized to designate identical or corresponding parts throughout the several views.

Figure 1:
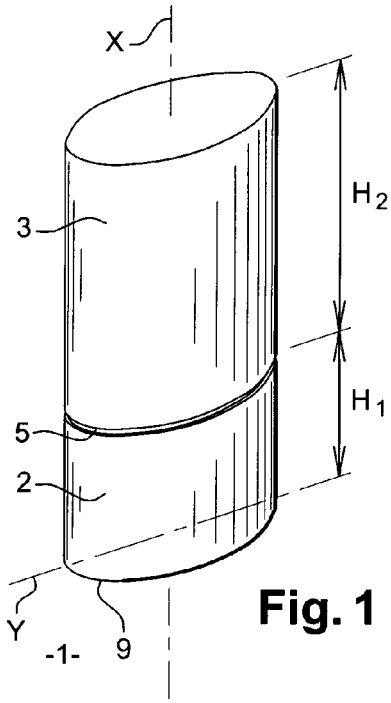
FIG. 1 is an outline perspective view of an example of a device with a cap mounted.

FIG. 1 depicts an example packaging and application device 1 that includes a base 2 on which there is mounted a cap 3 making it possible to conceal, in the assembled position depicted in FIG. 1, an application means provided in the device 1.

According to this example, the assembly including the device 1 and the cap 3 defines a cylinder that is generally centered on an axis X of translational movement of the cap 3 relative to the base 2, during mounting of this cap 3 on the device 1. The cap 3 can be limited in size to the maximum cross-section of the base 2. In this example, a section transverse to the axis X of the assembly has an outwards-convex outline, for example of ovoid shape. For example, the transverse section is elliptical with major axis Y.

Along the axis X, in the assembled position, the base 2 has a height H1, and the cap a height H2. The ratio of the height H1 to the sum of the heights H1 and H2 corresponds substantially to the height of the assembly in the assembled position. This ratio can be, for example, between 0.3 and 0.4, and can be, for example, preferably of the order of ⅓. According to a preferred example, the height H1 corresponds to the thickness of a thumb. This is because the base can be, configured to be picked up by gripping between two fingers, for example between the thumb and the index finger. H1 can be, for example, between 1 and 3 centimeters, and, in a preferred example, between 1.5 and 2 cm.

In order to make it possible to apply the contained product, the user removes the cap 3 from the base 2, which results in the device 1 appearing in the form shown in FIG. 2. The cap 3 is, for example, held on the base by latching means 4. Advantageously, the cap 3 can also include an annular lip 5 force-fitted in an annular space 6 defined by the base 2. The annular space 6 is defined at the level of an edge 7 of a side wall 8 of the base 2. The side wall 8 is arranged on a bottom 9 defined transversely to the axis X. A first outer annular skirt 10 is arranged on the edge 7, and has an external perimeter defined according to the generator of the external perimeter of the cylindrical side wall 8. The annular space 6 is defined between this first outer annular skirt 10 and a second inner annular skirt 11, extending according to the generator of the cylindrical internal perimeter of this side wall 8.

In this example, visible in particular in FIG. 2, the latching means 4 are in the form of a transverse flange 12 protruding towards the outside of the base 2, from the second inner annular skirt 11. The second inner annular skirt 11 has a height along the axis X greater than that of the outer annular skirt 10. In a preferred example, the inner annular skirt 11 has two transverse flanges such as 12, and these two flanges advantageously extend substantially parallel to the major axis Y of the ellipse formed by the external perimeter of the inner annular skirt 11. These latching means 4 are configured to cooperate with a complementary raised part provided inside the cap 3. Axial immobility of the cap 3 relative to the base 2 is thus obtained.

In order to provide the sealing of the closure, the annular lip 5 is gripped between the internal perimeter of the first outer annular skirt 10 and an annular bead 13 provided protruding from the second annular skirt 11 into the annular space 6. The cap 3 assembled on the base 2 thus makes it possible to define a sealed internal volume, static sealing being provided between these two parts. The product contained in the assembly is protected with regard to the external environment.

A tube 14 is arranged inside the base 2, the tube 14 being fitted inside the latter. Such a tube 14 then projects relative to said base 2. This tube 14 defines a product housing, and includes a dispensing opening 15 axially opposite the bottom 9.

Figure 3:
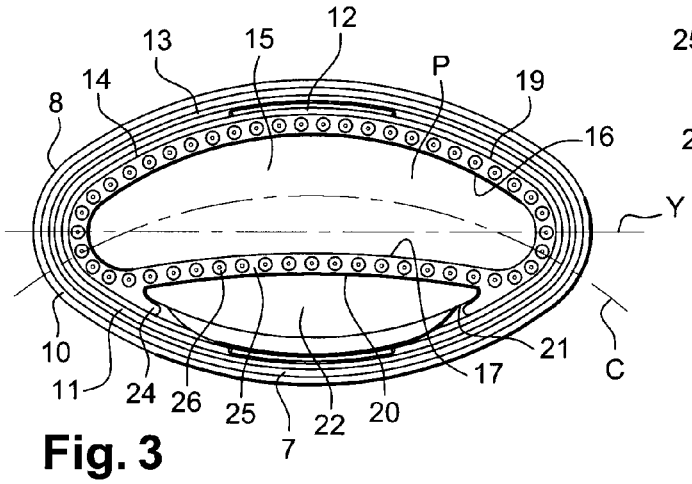
FIG. 3 is a top view of the dispensing opening of the example device of FIG. 2.

In FIG. 3, an inner cross-section of the tube 14 is "bean"-shaped. This is because this inner cross-section comprises an inwards-concave portion 16 and an inwards-convex portion 17, as shown in FIG. 3. These concave 16 and convex 17 portions extend along a larger-sized side of a cross-section of the device. For example, these concave and convex portions can extend generally along the major axis Y, and either side of this axis. The dispensing opening 15 then has a cross-section substantially identical to that of the tube 14. Preferably, the portions 16 and 17 are facing each other so that the dispensing opening forms a slit extending along a curve C.

The portions 16 and 17 have different radii of curvature so that the width of the slit measured perpendicular to the curve C passes through a maximum in a middle area, at a distance from the ends of the portions 16 and 17. In the example depicted, the inwards-concave portion 16 has a smaller radius than the inwards-convex portion 17, so that at the ends there is a small radius which makes it possible to make up the eyelashes of the corner of the eye, and at the centre there is a larger width in order to allow filling and obtain a large volume of product.

The tube 14 can be cylindrical and generally parallel to the axis X. A side wall 18 of this tube has an outer face having an outwards-convex profile 19 and an outwards-concave profile 20 in correspondence with the concave 16 and convex 17 portions respectively. The side wall 18 has, in this example, a substantially constant thickness. The outwards-convex profile 19 also extends substantially along the curve C. It is placed in contact with the internal perimeter of the inner annular skirt 11. Preferably, this curve C extends along the major axis Y of the ellipse formed by the cross-section of the base 2. A space 21 therefore exists between the outwards-concave profile 20 and the internal perimeter of the side wall 8.

A driving mechanism 22 is partly disposed in this space 21. The driving mechanism 22 includes a pushbutton 23 housed in the space 21 and cooperating with a platform disposed inside the tube 14, such that a movement of the pushbutton along the axis X allows a translational movement along this axis of the platform in the tube 14 with a view to the dispensing of product via the dispensing aperture 15. The pushbutton 23 can be limited in size to the maximum cross-section of the base 2, and can even be limited in size to the maximum cross-section of the annular bead 13.

Figure 11:
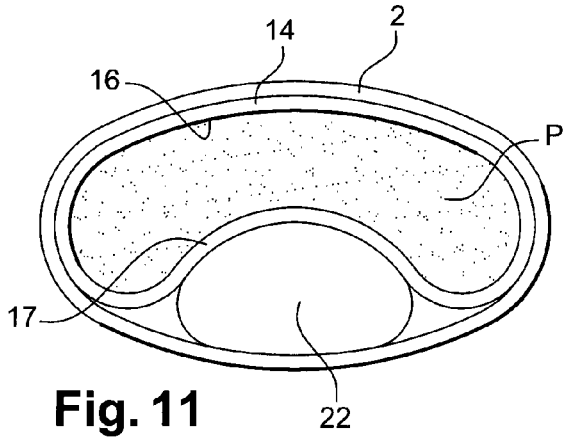
FIGS. 11 to 15 are schematic top views of the dispensing opening of variant embodiments of an example device.
Figure 12:
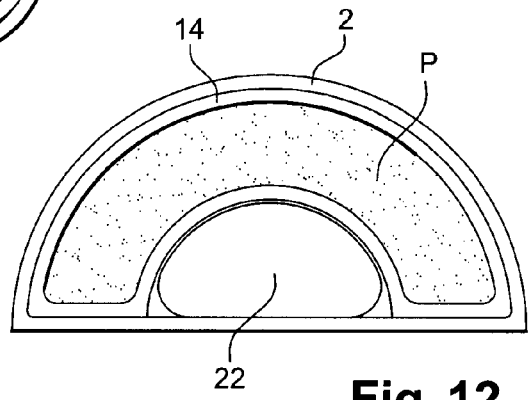

In a variant example, the inwards-concave portion 16 can have an identical radius of curvature, and therefore be superposable on that of the inwards-convex portion 17. In another variant example, depicted in FIG. 11, the radius of curvature of the inwards-concave portion 16 can be greater than that of the inwards-convex portion 17. In a variant example illustrated in FIG. 12, the external perimeter of the base 2 defines a semi-circle, inside which the tube 14 delimiting the housing for the product P is disposed. The internal and external perimeter of the tube 14 represents a half-ring.

Figure 13:
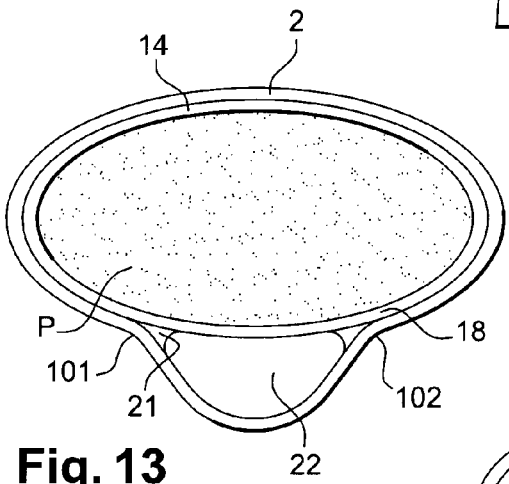

In a variant example shown in FIG. 13, the tube 14 has an entirely inwards-concave profile, and is arranged in a base 2 having two concavities outwards, forming respectively two inwards-convex portions 101 and 102. In this example embodiment the driving mechanism 22 is housed in the space 21 defined between the external perimeter of the side wall 18 and the concavity inwards defined by the wall 8 between the two convex portions 101 and 102. In another variant example, depicted in FIG. 14, the tube 14 includes two inwards-convex portions 111 and 112, and the base 2 has an inwards-convex portion 113. The convex portion 113 of the base 2 is disposed opposite the convex portion 111 of the tube 14, the driving mechanism 22 being disposed between the second convex portion 112 of the tube 14 and the base 2.

Figure 14:
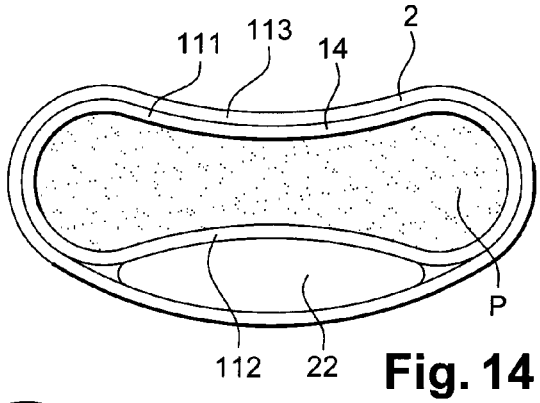
Figure 15:
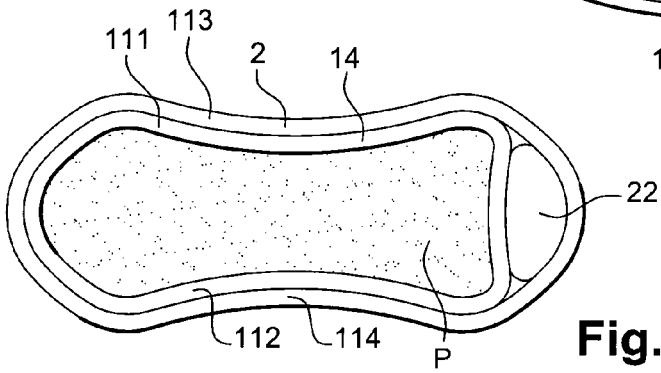

In a variant of the example in FIG. 14, FIG. 15 depicts the tube 14 including two inwards-convex portions 111 and 112 opposite respectively two inwards-convex portions 113 and 114 of the base 2. A space 21 is nevertheless made between the wall 18 and the base 2 in which the bulk of the driving mechanism 22 can be placed.

According to an example, the outer cross-section of the base is not homothetic with the inner cross-section of the tube 14.

The pushbutton 23 has an outline and/or a surface effect for facilitating its handling. For example, the pushbutton includes a hollow configured to cooperate with the pad of the end of the thumb.

Figure 4:
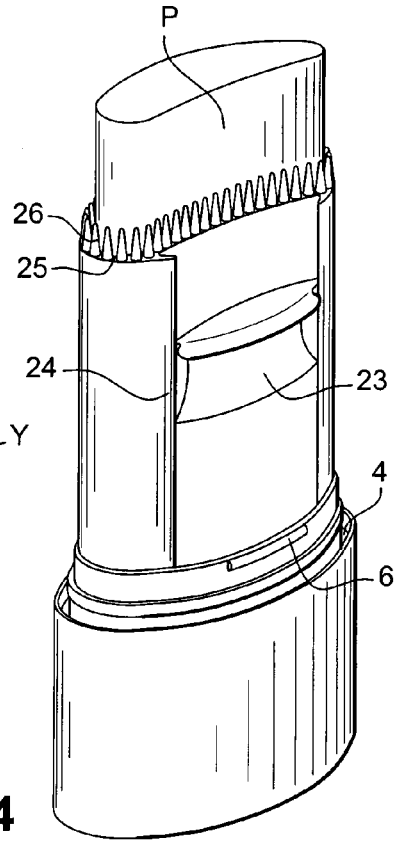
FIG. 4 is an outline perspective view of an example device with the pushbutton in a middle position.

The side wall 18 includes guide rails 24 for cooperating with the pushbutton 23. In FIG. 4, the pushbutton is in a middle position between a free edge of the second inner skirt 11 and the dispensing opening; the product presented here in the form of a solid cake is sticking out partly outside the dispensing opening 15.

The pushbutton 23 is movable relative to the tube 14 between a low position and a high position. In the low position, as can be seen in FIG. 2, a free axial end of the pushbutton, relative to its translational movement axis X, protrudes from the base 2 and is situated in proximity to the free edge of the second inner skirt 11. On the other hand, in the high position, the free axial end is disposed substantially in the plane of the dispensing opening 15, and for example at the level of the free edge 25 of the side wall 18 of the tube 14.

Separating/combing elements such as a row of tapered teeth 26, of conical structure with circular base, can be distributed regularly over the free edge 25, for example. They can be arranged substantially parallel to the axis X, for example. Even in the high position, the pushbutton remains below the plane in which the free ends of the teeth 26 are defined. The teeth 26 can be conical and have a circular base of diameter 0.8 mm, the diameter at the free end being of the order of 0.3 mm, and a height of the order of 3 mm. Advantageously the teeth 26 are spaced apart from one another by approximately 1.4 mm.

Figure 5:
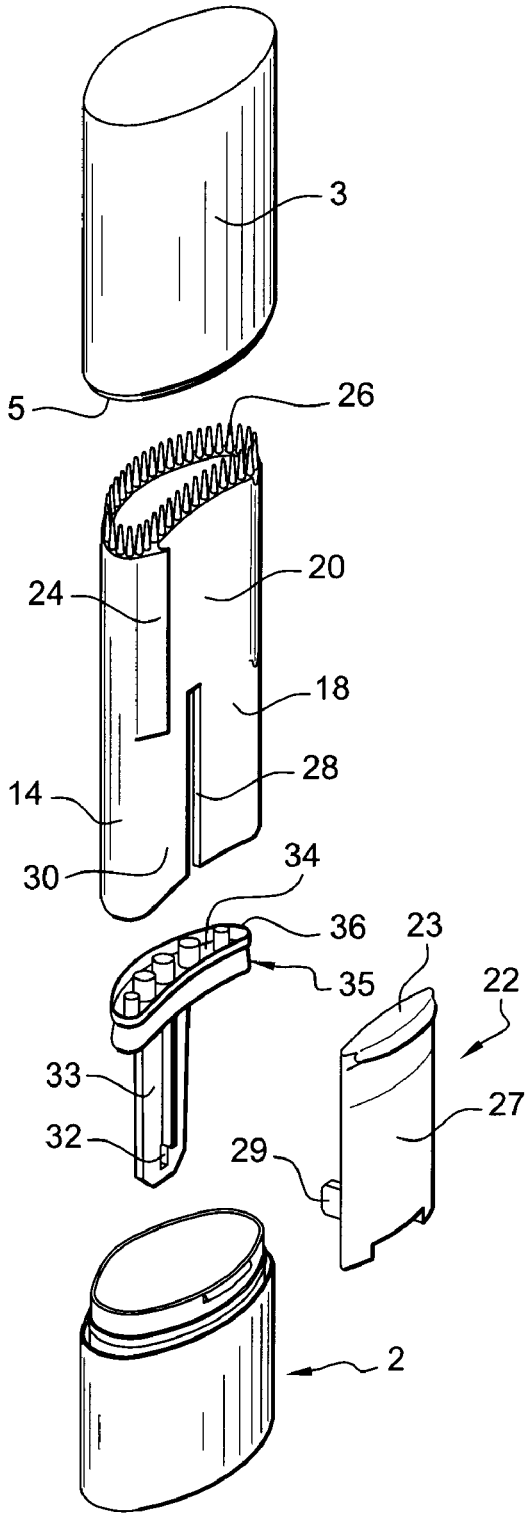
FIGS. 5 and 6 are two exploded perspective views of an example device.
Figure 6:
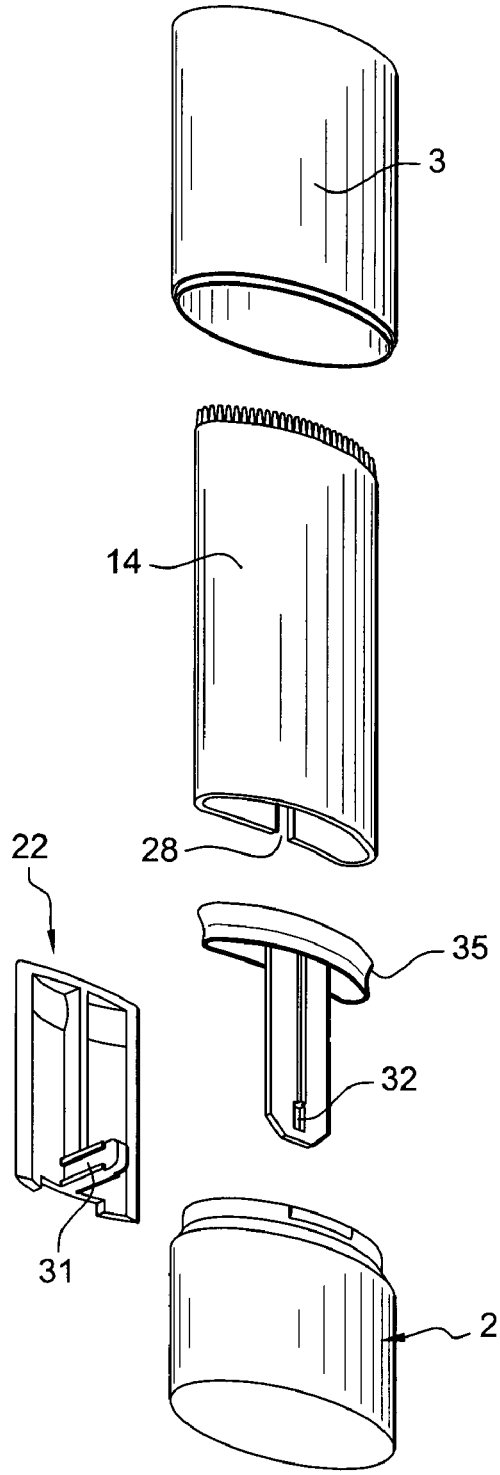

The pushbutton 23 includes a wall forming a screen 27 (depicted in FIG. 5) which comes out progressively from the base, when it is brought from the low position to the high position. This screen 27 is initially concealed in the base 2 in the low position. This screen 27 includes, as can be seen in the exploded views of FIGS. 5 and 6, a lug 29 arranged transversely to this screen, at a free end opposite to the free end of the pushbutton configured to be manipulated.

The lug is configured to pass through a slot 28 formed in an axial portion 30 of the side wall 18. For example, the slot 28 is formed in the outwards-concave face 20. The slot 28 guides the sliding of the pushbutton along the tube 14. Advantageously, the slot 28 is formed in the portion of the tube 14 contained in the base. It is concealed by both the base and the pushbutton 23, for example by the screen 27 of the pushbutton 23. The slot 28 opens out at an axial end opposite to the one defining the dispensing opening 15. Thus the lug 29 can be inserted into the slot 28 by translational movement along the slot 28.

The lug 29 includes an end 31 (shown in FIG. 6) fitted into an aperture 32 formed in a rod 33 sticking out from a bottom 34 of the platform 35 on which the product is disposed. The rod 34 sticks out in a direction opposite to the direction of the low position towards the high position along the axis X. The end 31 can be latched, or else clamped. Alternatively, given the confinement of the pushbutton and the platform relative to the tube, the fitting can be flexible, the only mobility permitted being axial along the axis X.

Figure 7:
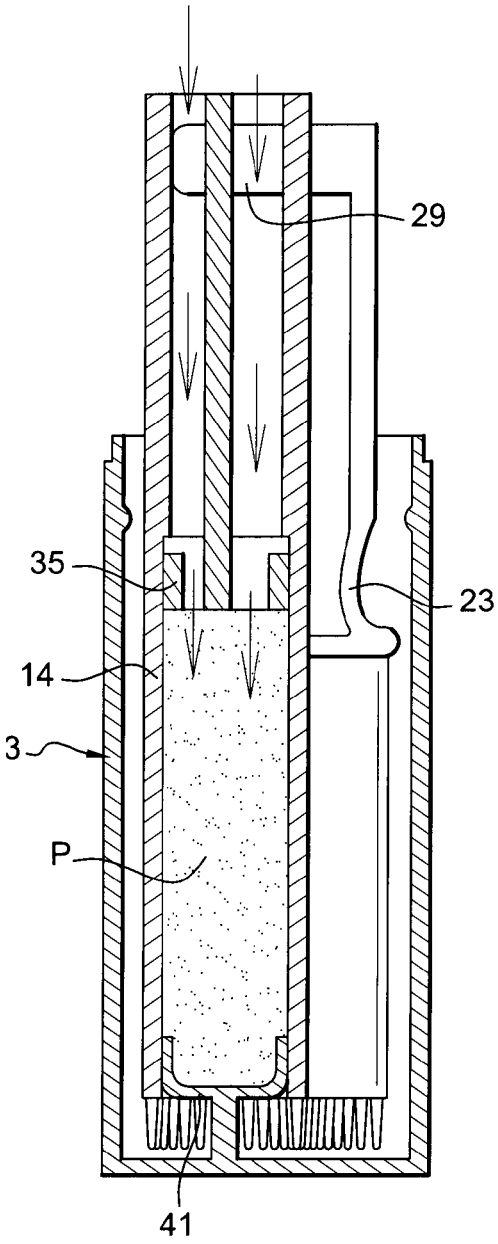
FIGS. 7 and 8 are two longitudinal sectional views of variant embodiments of an example device, during filling.
Figure 8:
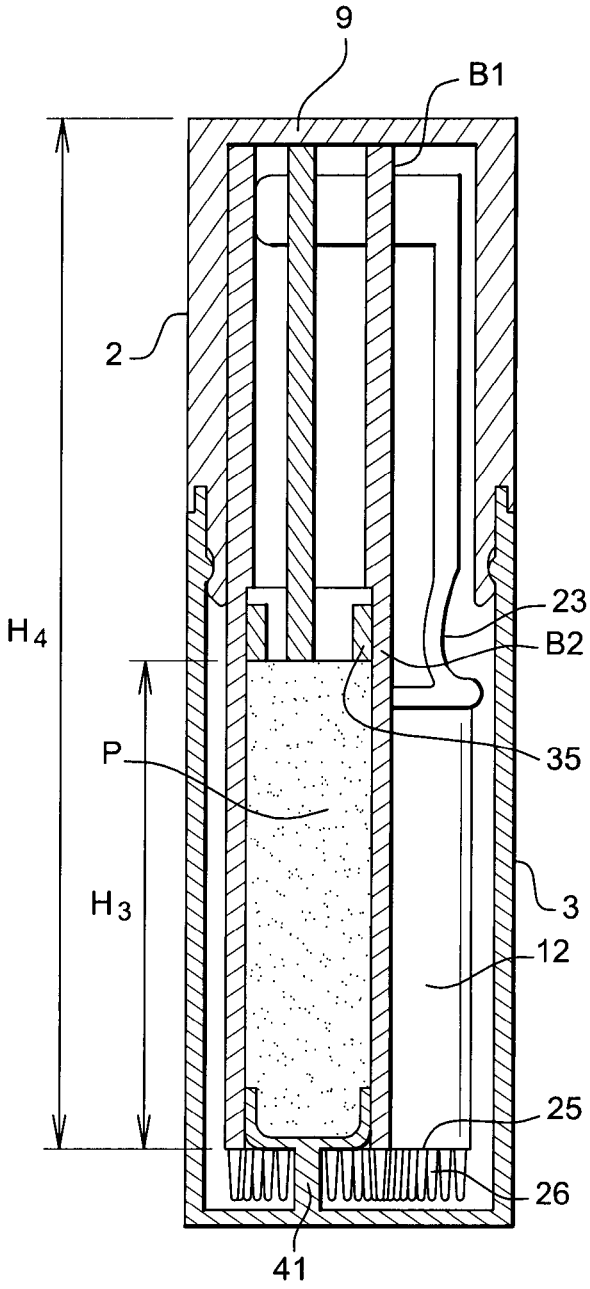

As can be seen in FIGS. 7 and 8, the rod 33, which is inside the tube, is situated in the portion concealed by the base 2 when the pushbutton 23 is in the low position. The slot 28, in cooperation with the bottom 9, forms a first limit stop B1 for translational movement of the pushbutton relative to the tube. The low position is thus determined.

It is possible in this low position to provide the platform 35 with sealed fitting with the internal perimeter of the tube 14. To that end, the external perimeter of the platform can have a perimeter identical to the transverse section of the internal perimeter of the side wall 18, for example. On the other hand, there is preferably no dynamic sealing provided between the platform and the internal perimeter of the tube when the platform is driven translationally inside the tube 14. This is because the internal perimeter of the side wall widens out slightly in the direction of its dispensing opening 15.

The platform 35 includes an annular lip 36 for delimiting the seat intended to receive the product to be dispensed. This annular lip 36 can come into sealed elastic contact with the internal perimeter of the side wall, for example in the low position.

The slot 28 includes a second limit stop B2 axially opposite the first limit stop B1, this second limit stop being situated below the level of the annular lip 36 when the pushbutton is in the low position. Therefore the height of product H3 before the first use can correspond to the distance between the platform 35 in the low position and the plane of the free edge 25. This height H3 is for example of the order of 3 cm. The total height H4 between the bottom 9 of the base and the free edge 25 of the tube 14 when the latter is mounted is substantially equal to twice the height H3. The ratio R of the height H3 to the height H4 is of the order of 0.5, as depicted in FIGS. 7 and 8.

Figure 9:
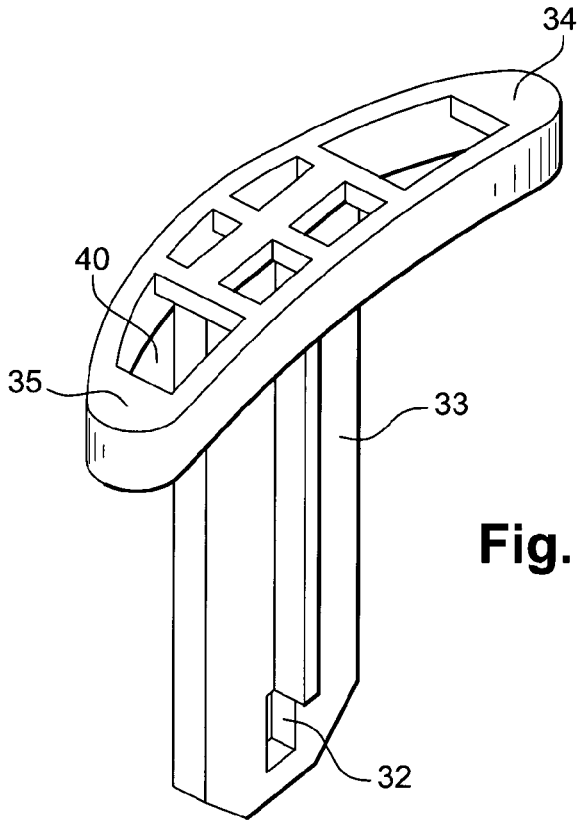
FIG. 9 is a perspective view of one embodiment of a platform of an example device.

In a variant embodiment of the platform 35 as depicted in FIGS. 1 to 6, where the bottom 34 is solid, in FIGS. 7 to 9 the bottom 34 is permeable to the product. To that end it includes wide apertures 40. These apertures 40 (shown in FIG. 9) can be, for example, provided to allow filling with product via the bottom, the base 2 not being disposed around the tube. For filling the devices according to the embodiment of FIGS. 7 and 8, the upper lip of the platform 35 being gripped in the tube 14, it prevents the pushbutton from sliding by gravity in the direction of its high position. A plug 41 is also provided, arranged inside the tube in order to close up the housing and shape the free end of the product hot-cast in its housing. The plug 41 has a gripping means protruding into the cap to facilitate its withdrawal upon first use.

The distance between the two limit stops B1 and B2, reduced by the axial height of the lug 29 at the level of the slot 28, defines the permitted axial travel of the platform 35 in the tube and corresponds substantially to the distance between the low position and the high position. Advantageously, when the pushbutton is in the high position, the platform 35 is situated substantially at the level of the dispensing opening 15.

In a variant, not depicted, a member permeable to the product can be disposed at the dispensing opening 15. This permeable member can be porous, fibrous, cellular, or with several channels running through it. Thus the rate and dispensing of the product at the opening can be modified. A more liquid formula can thus be dispensed. In this case, provision is made for the platform to be in sealed contact with the tube 14 over the entire height between the low position and the high position. For example, where the device is devoid of teeth such as 26, then the device 1 can be used for the application of lipstick or deodorant.

In a non-limiting variant of the invention, the free edge 25 might not include any separating/combing elements 26.

The base 2, cap 3, tube 14, pushbutton 23 and platform 35 are for example obtained by moulding. They are for example respectively made from polyethylene, polypropylene, polyamides, polyacetal and polystyrene. Preferably, the platform 35 and the tube 14 will not be made from the same material in order to avoid friction between two components with the same coefficient of friction. Thus the movement of the platform 35 relative to the tube 14 can be fluid and without causing a grating noise.

Figure 10:
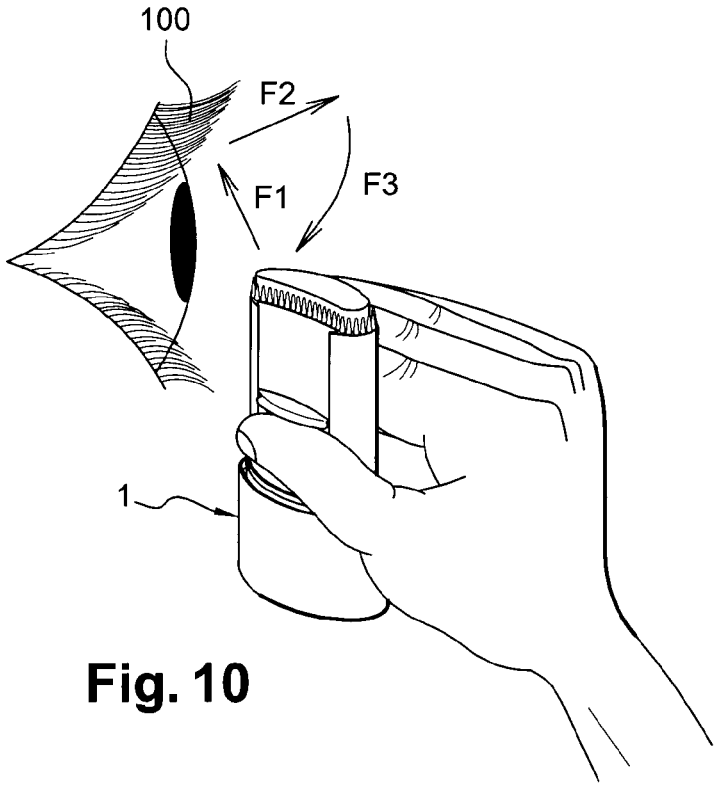
FIG. 10 is a view during use of an example device.

As depicted in FIG. 10, the device 1 according to the invention can be, for example, configured for applying a paste-like product onto the eyelashes. This device is innovatory for the users, as is the movement for use. This is because the use of such a device takes place preferentially by bringing the device into contact with the base of the eyelashes, positioning the major axis Y substantially tangential to the cornea, and the path that the user imposes on the device in order to obtain the desired coating of their eyelashes follows a loop according to a movement whereof the components are defined in a plane perpendicular to the cornea and parallel to the bridge of the nose. The movement breaks down into three stages, and corresponds to the movements F1, F2 and F3 shown schematically in FIG. 10.

According to this application movement, the user preferably positions the curve C defined by the dispensing opening 15 substantially parallel to the curve formed by the free edge 100 of the eyelid where the eyelashes are located.

Advantageously, the edges defined at the junction between the portions 16 and 17 respectively allow improved treatment of the edges of a row of eyelashes, for example for coating the eyelashes of the inner and outer edge of the eye, including localized touching up. In this case, the movements of the device are still performed in the plane perpendicular to the cornea and parallel to the bridge of the nose, but in this case, the major axis Y is disposed in this plane.

Throughout the description, including the claims, expressions such as including, comprising or having should be understood to be synonymous with "including at least", unless otherwise specified.

In the detailed description above, reference has been made to preferred embodiments and examples of the invention. However, obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A packaging and application device for a cosmetic product comprising:

a platform, a tube that includes a side wall that extends in a longitudinal direction of the device and that defines a housing for said product, and a driving mechanism for translational movement of the platform in the tube in the longitudinal direction, the movement of the platform allowing dispensing of product via a dispensing opening in the tube, the tube being arranged in a base, the base including a side wall that extends in the longitudinal direction, wherein at least one of a cross-section of the side wall of the base or a cross-section of the side wall of the tube comprises an inner surface that defines a convex portion, wherein the base and the tube include a non-homothetic cross-section, and wherein the drive mechanism includes a pushbutton that is disposed entirely between an outer surface of the side wall of the tube and an inner surface of the side wall of the base with respect to a direction transverse to the longitudinal direction, the inner surface of the side wall of the base being a surface that extends in the longitudinal direction and faces the outer surface of the side wall of the tube.

2. A device according to claim 1, wherein the cross-section of the inner surface of the side wall of the tube includes a concave portion and a convex portion, and the outer surface of the side wall of the base includes a convex cross-section.

3. A device according to claim 1, further comprising a cap configured to cooperate with the base.

4. A device according to claim 3, wherein the cap provides sealed closure of the base.

5. A device according to claim 1, wherein the tube comprises a slot in which the driving mechanism slides.

6. A device according to claim 5, wherein the slot extends through an axial portion of the side wall that is surrounded by the base.

7. A device according to claim 5, wherein the pushbutton protrudes longitudinally from the base, and the driving mechanism further comprises a longitudinal portion extending into the base and having a lug passing through the slot.

8. A device according to claim 7, wherein the lug cooperates with a distal end of a rod sticking out from a bottom of the platform, the rod extending into the tube in the direction of a bottom of the base.

9. A device according to claim 7, wherein the pushbutton comprises a free end disposed substantially at a level of the platform, the slot being configured to allow the movement of the platform as far as the level of the dispensing opening in the tube.

10. A device according to claim 5, wherein the slot comprises two axial limit stops.

11. A device according to claim 1, wherein the platform forms a seat for receiving a stick of said product.

12. A device according to claim 1, wherein the platform is in sealed contact with the side wall of the tube, in at least one position of the platform in the tube.

13. A device according to claim 1, wherein the ratio of the height of product before a first use of the device to the total height of the device is between 0.3 and 0.8.

14. A device according to claim 1, wherein the platform is permeable and the tube comprises a second opening, axially opposite the first opening, so as to allow casting of the product in the housing.

15. A device according to claim 1, wherein the dispensing opening in the tube is closed off.

16. A device according to claim 1, wherein the dispensing opening in the tube includes a perimeter inner cross-section substantially identical to that of the inner cross-section of the tube.

17. A device according to claim 1, wherein separating/combing members are arranged at the periphery of the dispensing opening, the separating/combing members extending parallel to an axis of translational movement of the platform in the tube.

18. A device according to claim 2, wherein the concave portion and the convex portion of the side wall of the tube are substantially superposable, and disposed opposite each other so that the dispensing opening forms a curved slit.

19. The device according to claim 1, wherein the driving mechanism is housed within the base such that only the pushbutton of the driving mechanism extends above the base when the driving mechanism is in a low position.

20. The device according to claim 1, wherein the driving mechanism is disposed between a portion of the outer surface of the side wall of the tube that is concave and a portion of the inner surface of the side wall of the base that is concave.

21. The device according to claim 1, wherein a cross-sectional area of the pushbutton does not overlap a cross-sectional area of the side wall of the tube or a cross-sectional area of the side wall of the base.

22. The device according to claim 1, wherein a perimeter of the pushbutton lies entirely within a perimeter defined by the side wall of the base, and wherein the perimeter of the pushbutton does not overlap the side wall of the tube.

23. The device according to claim 1, further comprising a cap that is configured to cooperate with the base so as to enclose the pushbutton.

* * * * *